US006764042B2

(12) United States Patent
Moore et al.

(10) Patent No.: US 6,764,042 B2
(45) Date of Patent: Jul. 20, 2004

(54) PRECISION GUIDED EXTENDED RANGE ARTILLERY PROJECTILE TACTICAL BASE

(75) Inventors: James L. Moore, Tucson, AZ (US); Gary H. Johnson, Tucson, AZ (US); William S. Peterson, Tucson, AZ (US); Rajesh H. Shah, Tucson, AZ (US); Richard Dryer, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/435,834

(22) Filed: May 12, 2003

(65) Prior Publication Data

US 2004/0108412 A1 Jun. 10, 2004

Related U.S. Application Data

(63) Continuation-in-part of application No. 09/981,242, filed on Oct. 16, 2001, now Pat. No. 6,588,700.

(51) Int. Cl.[7] ..... F42B 10/00

(52) U.S. Cl. ..... 244/3.28; 244/3.27; 102/473; 102/501

(58) Field of Search ..... 244/3.24, 3.28, 244/3.29, 3.25, 3.27; 102/473, 501

(56) References Cited

U.S. PATENT DOCUMENTS

| | | | | | |
|---|---|---|---|---|---|
| 4,332,360 | A | * | 6/1982 | Topliffe | 244/3.27 |
| 4,334,657 | A | * | 6/1982 | Mattson | 244/3.28 |
| 6,126,109 | A | * | 10/2000 | Barson et al. | 244/3.28 |
| 2001/0030260 | A1 | * | 10/2001 | Niemeyer et al. | 244/3.26 |

* cited by examiner

*Primary Examiner*—J. Woodrow Eldred
(74) *Attorney, Agent, or Firm*—Larry K. Roberts; Thomas J. Finn; Philip P. Berestecki

(57) ABSTRACT

A tacital base for a guided projectile includes a base structure, and an adaptor structure for securing the base structure to a forward section of the projectile. The base further includes a plurality of fin slots. A plurality of deployable fins are pivotally mounted to the base structure and supported for movement between a stowed position and a deployed position.

22 Claims, 10 Drawing Sheets

PRECISION GUIDED EXTENDED RANGE ARTILLERY PROJECTILE TACTICAL BASE

CROSS-REFERENCE TO RELATED APPLICATION

This is a continuation-in-part of application Ser. No. 09/981,242, filed Oct. 16, 2001, now U.S. Pat. No. 6,588,700.

TECHNICAL FIELD OF THE DISCLOSURE

This disclosure is directed to projectiles such as used in artillery, and more particularly to interfaces between the explosive payload and the propelling charge.

BACKGROUND OF THE DISCLOSURE

Projectiles for artillery systems must survive an extremely severe environment during launch. This includes high pressure, shock waves and extreme accelerations from the initial explosion of the propellant charge. The severe environment also includes a muzzle exit event on the projectile structure, which results in rapid depressurization and dynamic depressurization loads. The gun used to launch the projectile typically has a muzzle brake, requiring any fins to clear the brake before deploying. This is a significant design requirement, which is difficult to achieve for most systems.

SUMMARY OF THE DISCLOSURE

A tactical base for a guided projectile is described, and includes a base structure including a plurality of fin slots. A plurality of deployable fins are pivotally mounted to the base structure and supported for movement between a stowed position and a deployed position.

BRIEF DESCRIPTION OF THE DRAWING

These and other features and advantages of the present invention will become more apparent from the following detailed description of exemplary embodiments thereof, as illustrated in the accompanying drawings, in which:

FIGS. 4A and 4B are isometric partial views of a sector of the base structure, taken along lines 4A—4A and 4B—4B.

DETAILED DESCRIPTION OF THE DISCLOSURE

Figure 1:
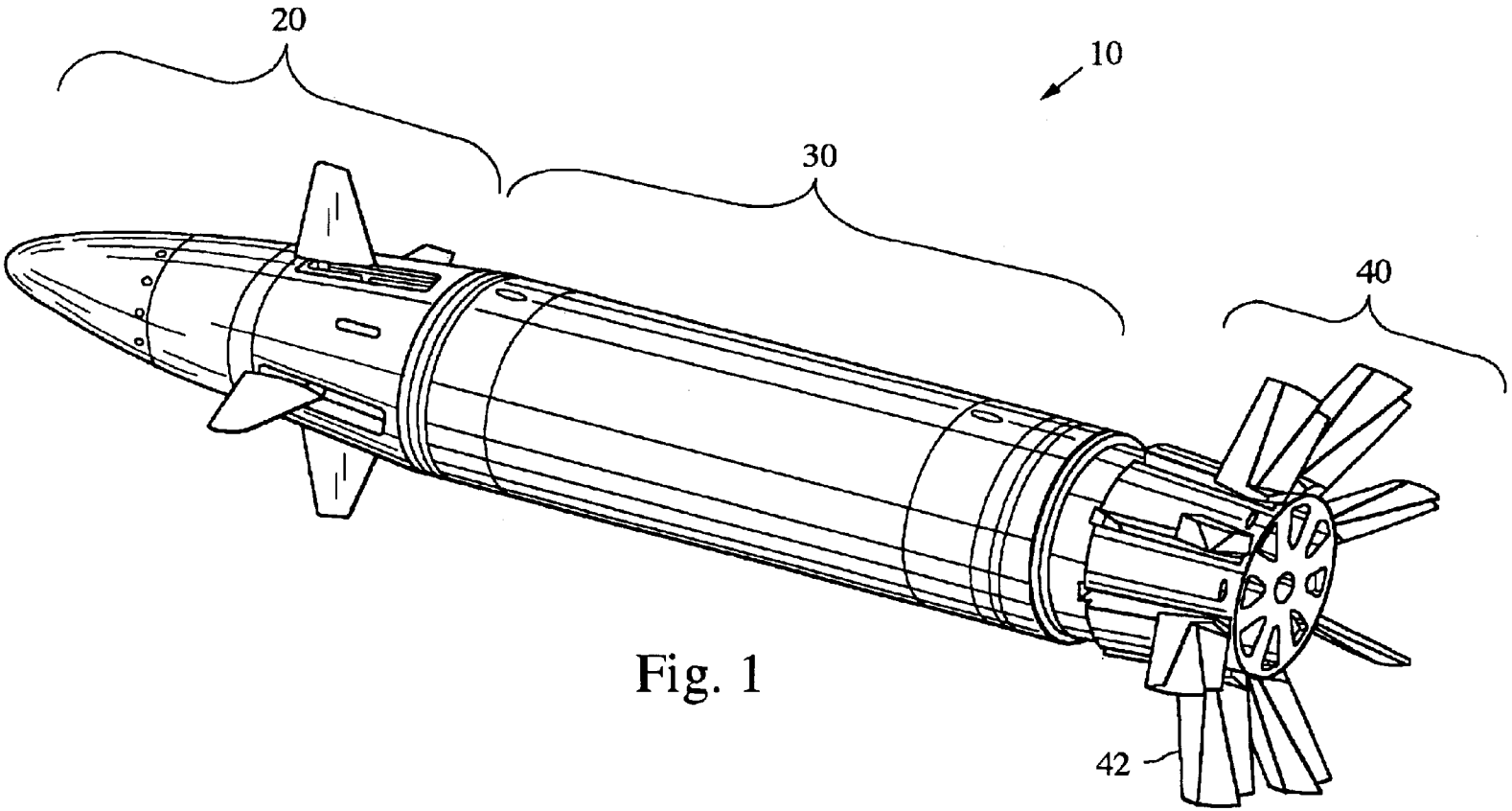
FIG. 1 is a simplified isometric view of an exemplary embodiment of a guided projectile.

The aft most component of a guided projectile, referred to as the base, performs an important role in the success of a weapon system. The base provides the interface between the extreme pressures and shock loads resulting from the explosion of the propellant charge in the gun and the rest of the projectile. In addition, the base supports aerodynamic fins, which slow the rotation of the projectile as well as providing stabilization and lift. The fins remain stowed during the firing and deploy after the projectile exits the gun barrel and muzzle brake. The base also supports a projectile obturator, which is a device which seals the gap between the gun barrel bore and the projectile body. It maximizes the efficiency of the propellant charge impulse forces, and also rotates relative to the projectile to reduce the spin rate imposed on the projectile by the gun rifling.

The invention is applicable to guided projectile systems of various size and performance requirements. The exact configuration and materials of the described embodiment can be adjusted based on the particular system requirements for other applications.

FIGS. 1–8 illustrate an exemplary embodiment of a guided projectile 10 in accordance with aspects of this invention. It is to be understood that the drawings are not to scale, and are simplified diagrammatic illustrations of aspects of the invention. The projectile can be fired from a gun or artillery piece, e.g. a large caliber piece, say 155 mm. Of course, it is to be understood that the invention is not limited to a particular caliber, and can generally be employed in gun or rocket systems. In this exemplary embodiment, the projectile includes a guidance and control section 20, a payload section 30, typically including an explosive charge, and a tactical base 40.

Figure 3:
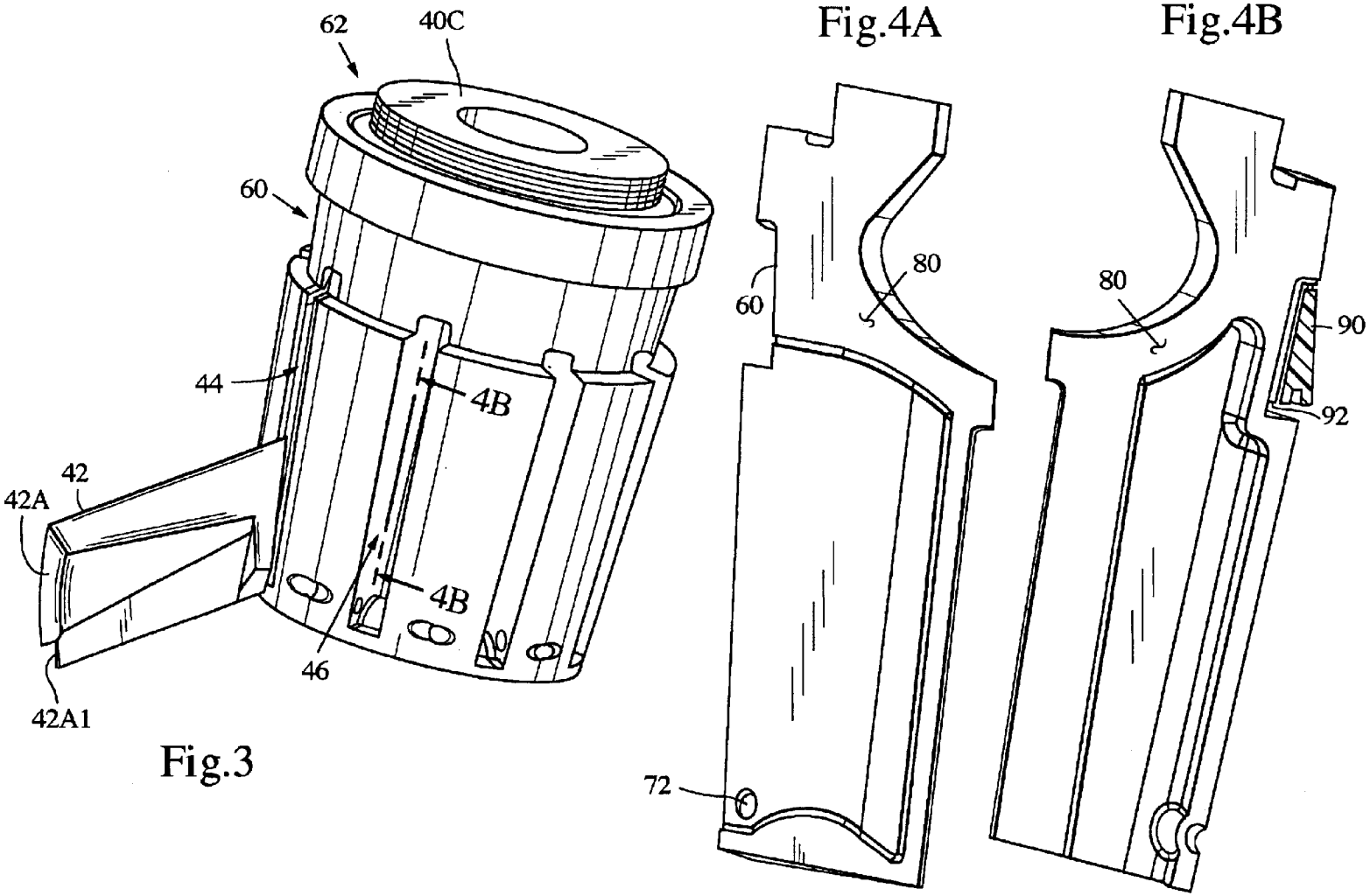
FIG. 3 is an isometric view similar to FIG. 2, but showing the fin in a deployed position.

The base 40 provides a protective interface between the explosive payload 30 on the projectile and the propelling charge from the gun. The base also provides aerodynamic flight stability. In order to provide aerodynamic flight stability, the base has mounted therein a set of fins 42, which deploy after the projectile 10 exits the gun barrel, as illustrated in FIGS. 1 and 3. In this exemplary embodiment, the base is designed to survive an extremely severe environment during launch. This includes high pressure, shock waves and extreme accelerations from the initial explosion of the propellant charge, as well as a muzzle exit event in which the projectile exits the gun barrel, which results in rapid depressurization. The gun used to launch the projectile may include a muzzle brake, which is cleared before the fins 42 deploy. The fins deploy within a set time post launch, and remain positionally true to the projectile airframe within tight tolerances.

Figure 2:
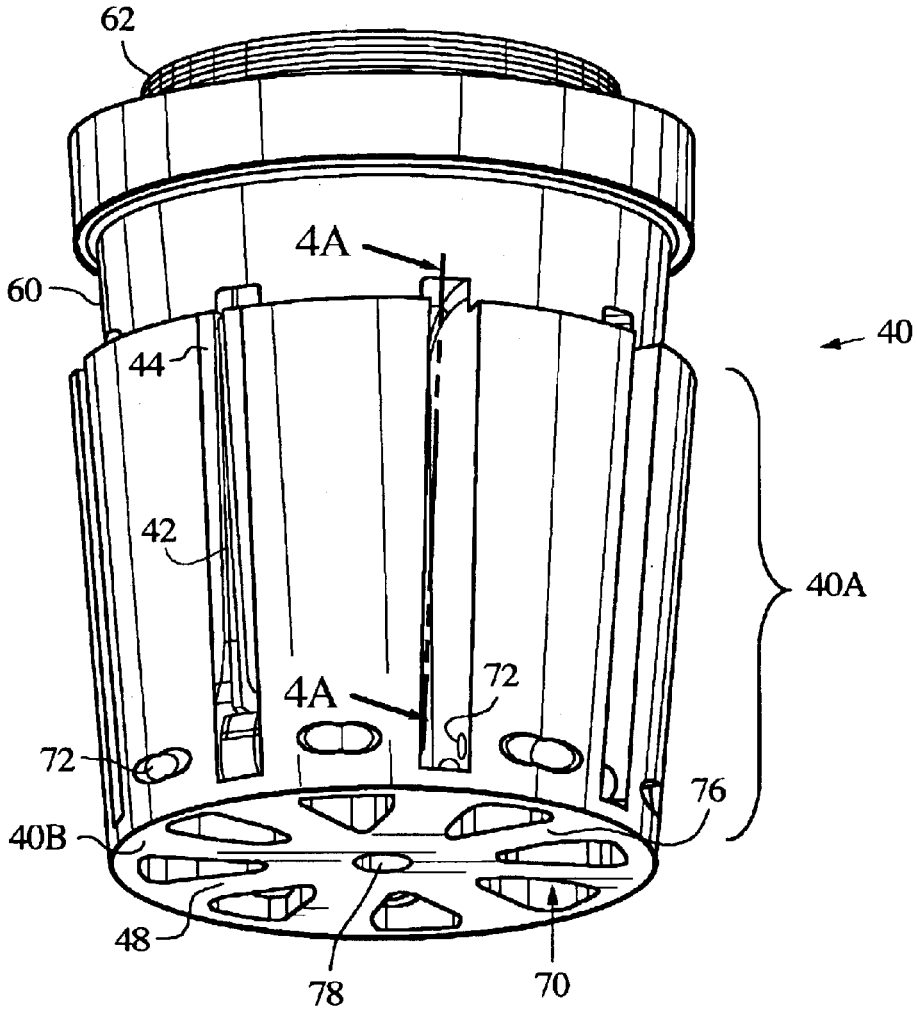
FIG. 2 is an isometric view of an exemplary embodiment of a base structure for the projectile of FIG. 1, showing one fin in a stowed position.

This exemplary embodiment of the base 40 integrates multiple features into a one piece construction, to which fins, inserts and pins are assembled. The base utilizes a hemispherical dome bulkhead 80 (FIGS. 4A, 4B, 5 and 8) to support high pressure launch loads transmitted to a lower conic section 40A (FIG. 2) and to support the linear loads of the payload. The lower conic or aft section 40A features numerous cavities 70 separated by walls or ribs 76 that work together with separate inserts 44 and fins 42 to provide a structure that can support itself with minimal material as well as providing a necessary fin retention device to ensure that the base will clear the muzzle brake prior to fin deployment. The cavities may or may not be filled with material such as wax or silicon rubber filler 110 (FIG. 7A). This "radially ribbed" structure significantly strengthens the dome bulkhead which allows it to be lighter in weight. The fins 42 (FIG. 3A) are completely protected in slots 46 during the launch and muzzle exit events, ensuring that they will not be damaged and will perform properly. Thus, in this embodiment, the fin slots are arranged such that the airflow as the projectile is launched or fired from the artillery piece will not have a tendency to travel into the fin slot and thus "bleed" out the back, increasing aerodynamic drag. An aft wall 48 (FIG. 5) closes the fin slots at the aft end of the base, protecting the fins from exit gases, and also preventing airflow from entering the fin slots 46 during flight. As shown in FIG. 2, the aft wall has openings which communicate with cavities 70 formed therein. This is a positive aerodynamic feature.

The base 40 in an exemplary embodiment is fabricated using an investment casting method, with very little post-casting machining required, from annealed Titanium 6AL4V. For this application, the material is required to have extremely high strain rate properties (high ductility), good fracture toughness to withstand the high impulse loading from the propellant explosion, and the ability to withstand high temperatures without appreciable loss of structural properties. Another property of titanium is that it is self-healing during a hot isostatic pressing process which removes voids in the casting. Other materials can also be employed, e.g. alternate titanium alloys. The fins can be fabricated from the same or similar material as used to fabricate the base 40.

The external shape of the base structure 40 provides a boattail shape (i.e. conic section 40A), and terminating at the aft section 40B for minimizing aerodynamic drag while providing dimensional interfacing requirements to the launch platform. While there are eight fins for this particular application, this can of course be adapted to accommodate any number of fins. When the fins 42 are stowed in the base 40, their trailing edges are generally parallel with the external conic section 40A. One fin 42 is shown in the stowed position in its insert structure 44 in FIG. 2, and in the deployed position in FIG. 3. There are eight equally spaced rectangular shaped radially positioned slots 46 formed in the base structure 40 to accommodate the stowed fins. An insert 44 completely fills the gap between the fin and slot, for reasons explained below. The fin is completely protected during the severe conditions of launch and muzzle exit. This will ensure that the fin will remain aligned so that it can perform its function as designed.

The base 40 has an externally positioned circumferential groove 60 which supports an obturator 90 (FIG. 4B), which for an exemplary application is a Nylon™ rotating band structure. The obturator 90 rotates about a fixed slip band 92 secured in the groove 60. The distance from the aft end 40B of the base to the forward end of the obturator is a design constraint for the launch platform. Just forward of this groove 60 is located a circumferential thread 62 which supports an adapter ring 94 (FIG. 8) which allows interfacing to different payloads. The adapter ring is designed with a thread to mate with the forward payload section, in a direction which is counter-rotational to the gun barrel rifling or the direction in which the projectile tends to rotate at launch. The adapter ring 94 can be modified to adapt to different payloads.

Figure 5:
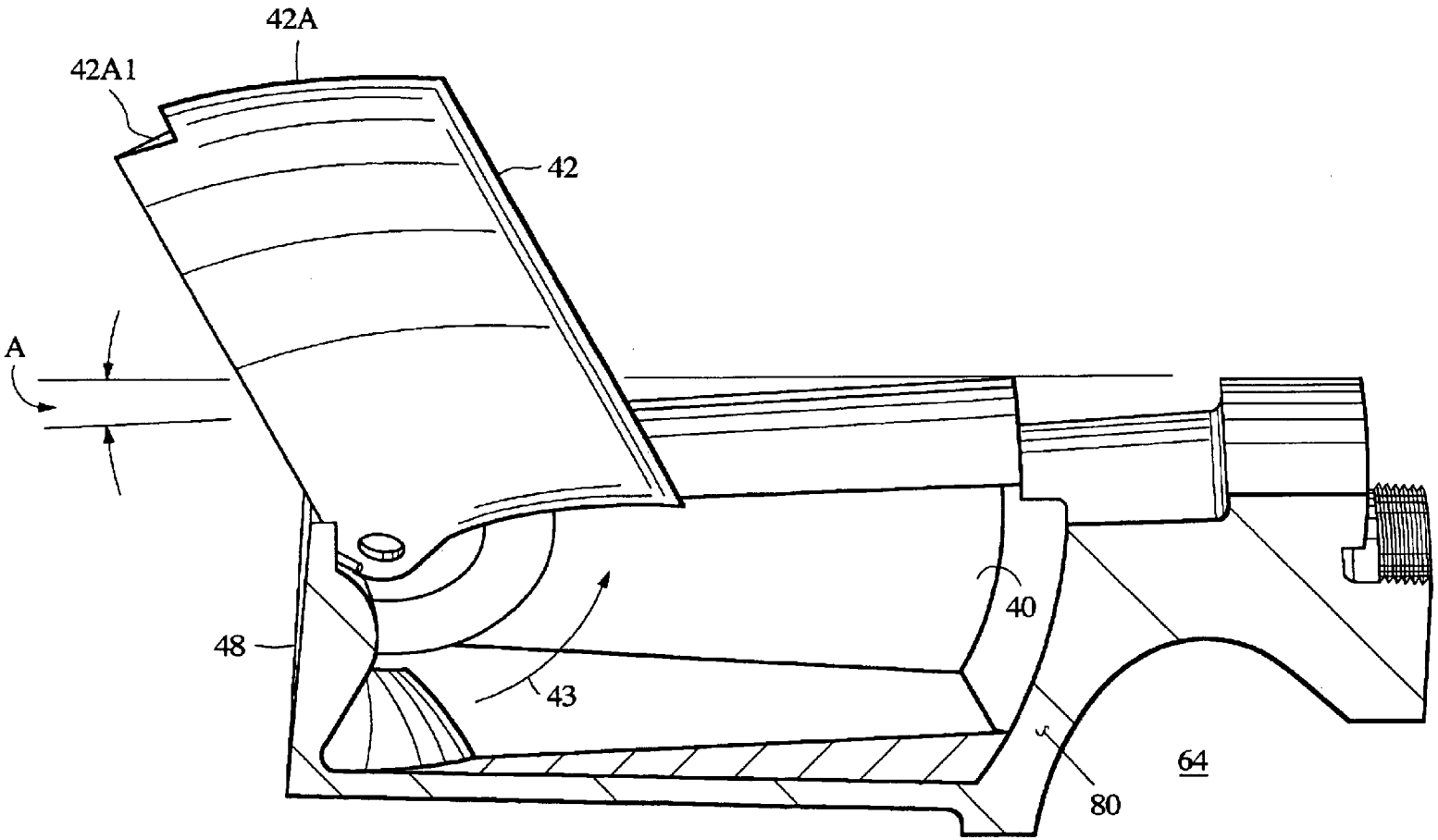
FIG. 5 is an isometric partial view of the base structure showing a portion of a fin in a deployed position.

Located inward from the forward end 40C of the base is a cavity 64 (FIG. 8) which provides weight reduction of the base. The shape of this cavity produces a hemispheric dome bulkhead 80 to resist the pressure of the propellant charge explosion. The bulkhead also provides a conic shape for the base in region 40A to efficiently support the payload during launch. This shape is a unique aspect of this design. As shown in FIG. 5, the conic shape is defined by angle A.

Referring now to FIGS. 4A–4B, located on the aft surface 40B of the tactical base are eight triangularly shaped cavities 70 which may or may not be filled with a soft material 110 (FIG.7A), e.g. wax or RTV silicon rubber, corresponding in number to the number of fins, which project forward into the: base 40 up to the hemispherical domed bulkhead 80. Located circumferentially about the aft end of the base are eight holes 72 which are perpendicular to each corresponding fin slot 44 to provide pin attachment locations for attaching the fin to the base via a pin mechanism. The holes 72 are precision bored through one side of the fin slot, breaking out the other side of the slot. Due to tight tolerances for this exemplary embodiment, the holes 72 are not cast in place with the fin slot. The pins are pressed into the opening 42B1 formed in the fin hub structure 42A (FIG. 6), with a slightly loose clearance fit in the holes 72. Providing clearance in holes 72 and press fit in the fin hub (part of 42) allows for better alignment control of the fin aerodynamic surfaces relative to the projectile's axis. Also, the technique of pressing the pins into the fin hub opening and the clearance hole 72 in the base 40 allows for a better length to diameter control of the pin for fin alignment.

The fins rotate about aft pivot points from a forward stowed position to an aft deployed position. This is so aerodynamic forces ensure rapid deployment to maintain projectile stability. If fins are hinged to pivot about forward pivot points, or opposite the aft pivots illustrated here, the aerodynamic forces would prevent rapid fin deployment, requiring special mechanisms adding cost and risk. In addition, fins which pivot about forward pivot points must be longer in span to provide similar stability as shorter fins pivoting from aft positions, as a function of distance from the projectile's center of gravity to the center of pressure of the fin panel area. Longer fins tend to break off due to Coriolis forces, while shorter fins not only package in smaller spaces but are typically more robust against the Coriolis forces.

The majority of loading on the base structure will be carried by the hemispherical dome bulkhead 80. By positioning the pivot points of the fins in aft positions, the loading on the fins will be reduced, thereby preventing distortion on the fin pivot axis.

The base structure aft of the dome shape contains numerous radial ribs 76, which reinforce the dome bulkhead allowing it to be thinner in cross section than if it was otherwise unsupported. This allows the weight of the base to be reduced. Located in the center of the base, projecting inward from the aft surface is a,cylindrical hole 78 used for lightening of the structure, which may optionally be filled with the soft material 110. This feature could be modified to adapt to a rocket motor nozzle for certain applications.

FIG. 5 shows a one sixteenth sector of the base with half of an insert and half of a fin in the deployed position is shown in FIG. 5. The fins 42 can be made of any of various metal alloys or composite materials (for this exemplary embodiment, the fin material is titanium). The trailing edge 42A of the fin at the tip has a notch 42A1 which allows the fin to be restrained by the obturator 90 when stowed (FIG. 3). The obturator disengages after exiting the gun barrel due to rapid dynamic depressurization. This is due to high pressure trapped gas under the obturator expanding and separating it for discarding. The fin is rotated forward and stowed with the tip inboard from the obturator in the non-operational condition. The fin is designed with its center of gravity (CG) inboard from the pivot point when stowed. The launch accelerations causes each fin to be forced into their respective slots due to this CG location, which prevents premature fin deployment inside the barrel.

Figure 6:
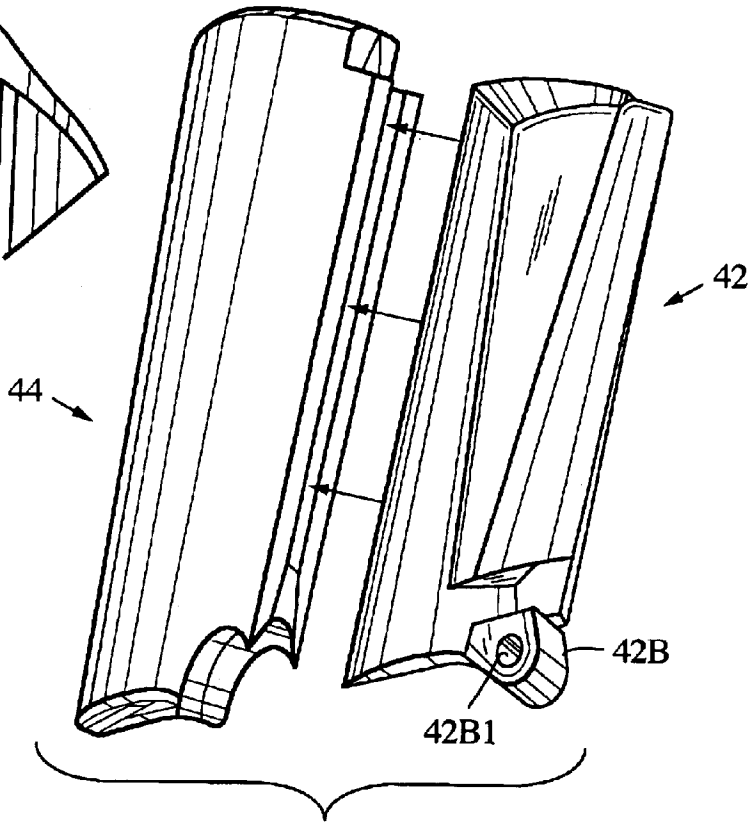
FIG. 6 is a diagrammatic isometric view of a fin and insert structure separated from the base structure.

Referring now to FIG. 6, the fin slot insert 44 is a separate piece which is installed into each fin slot in the base and houses the fin. Its function is to prevent high pressure gasses from getting trapped in the fin slots beneath the fin, and to support pressure loads on the wall between the triangular cavities and the fin slots. Trapped gases beneath the fins can prematurely deploy the fins at excessive rates at muzzle exit. The fin insert also transfers loads from these walls to the fins to provide a fin retention mechanism, which will be explained below. The insert 44 can be made of any of various materials including metal alloys, composites and plastics. For this embodiment, a nylon plastic material with a specific elastic modulus has been used to conform to each fin's external shape and fit into the corresponding rectangular slot in the base. In this example, for the titanium alloy 6AL4V used to fabricate the base, 6/12 moldable NYLON™ can be employed to fabricate the insert. Alternatively, the insert may be made from other suitable materials such as resins, structural foam or hard rubber.

The insert can be modified internally to conform to different fin panel geometries as required. The insert transfers the external profile of the fin into the corresponding rectangular shaped slot in the base, eliminating intricate expensive machining or casting processes to be required on the base. The insert 44 can be bonded in place in the base slot, using a void filler such as an adhesive. Alternatively, a snap-in device can be employed to retain the insert within the slot. The insert has a straight slot to allow the fin to exit, but the insert contours to the fin on its leading edge when stowed.

During gun firing, high pressure gases pass through the triangular cavities 70 up to the hemispherical domed bulkhead 80, and simultaneously surround the aft region 40A up to the obturator 90, providing a hydrostatic condition on the structure except for the area forward of the obturator and the weight reduction cavity 64 in the front of the base 40. The base begins to accelerate down the gun tube, forcing the forward end of the projectile ahead of it. The fins tend to rotate into a more stowed position due to inboard fin CG relative to the pivot. When the obturator 90 clears the end of the gun barrel, the barrel pressure begins to vent to atmosphere, while the pressure in the eight aft cavities 70 is still active. This captured pressure within the cavities begins to push the structural walls 76 toward the fin insert 44, which in turn transfers the load against the side of the fin. The structure of these walls is shown in FIG. 7A, a diagrammatic view showing the base 40 cut in half. This load transfer event on each side of the fin 42 creates a wedging action on the fin which provides a positive restraint against fin deployment until the aft cavity gas can decay allowing the walls to return to their previous position. This event allows the walls of the structure to be supported by the insert and fin so they do not experience permanent structural failure, allowing the walls to be reduced in thickness, and also retains the fins to prevent their deployment until they clear the muzzle brake. The base wall 76 between the fin slot and the triangular cavity also provides support for the outside wall of the aft area 40A.

Figure 7B:
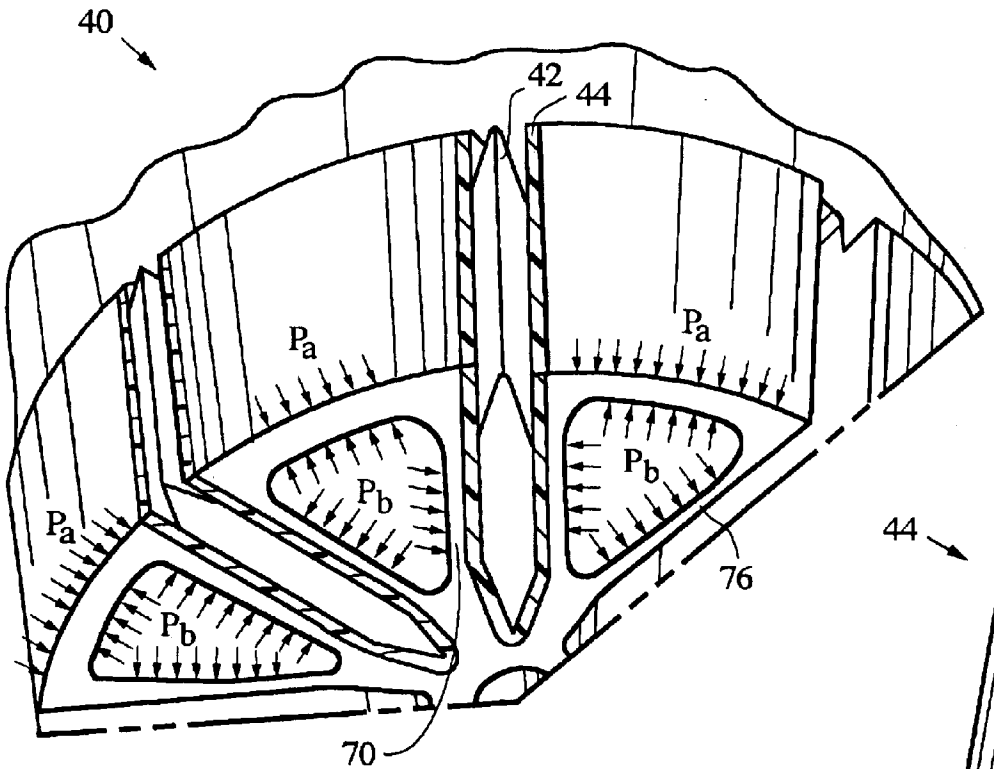
FIG. 7B is a partial cut-away view of a portion of the base structure, illustrating fin retention during launch of the projectile.
Figure 7A:
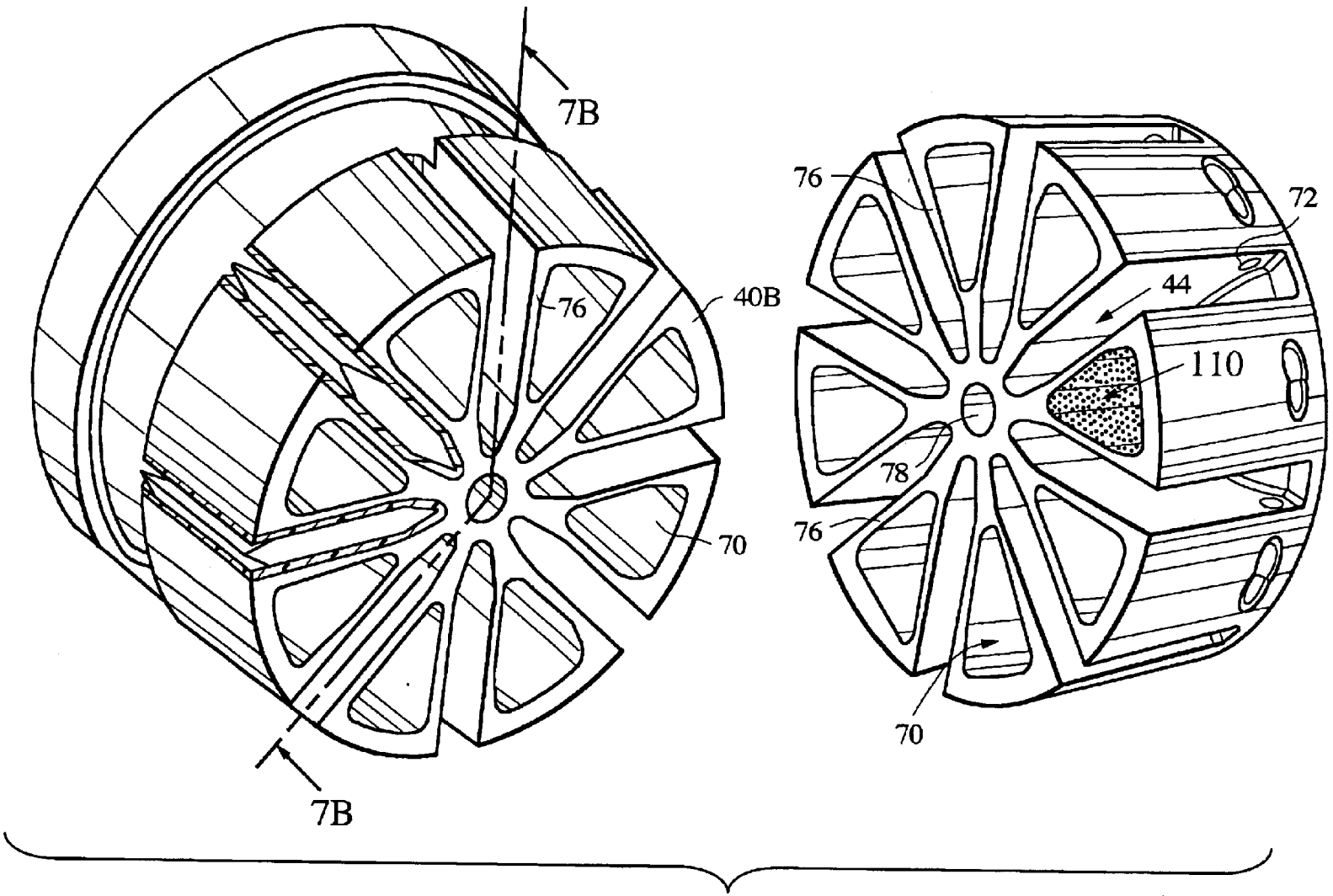
FIG. 7A is a cut-away diagrammatic view of the base structure.
Figure 8:
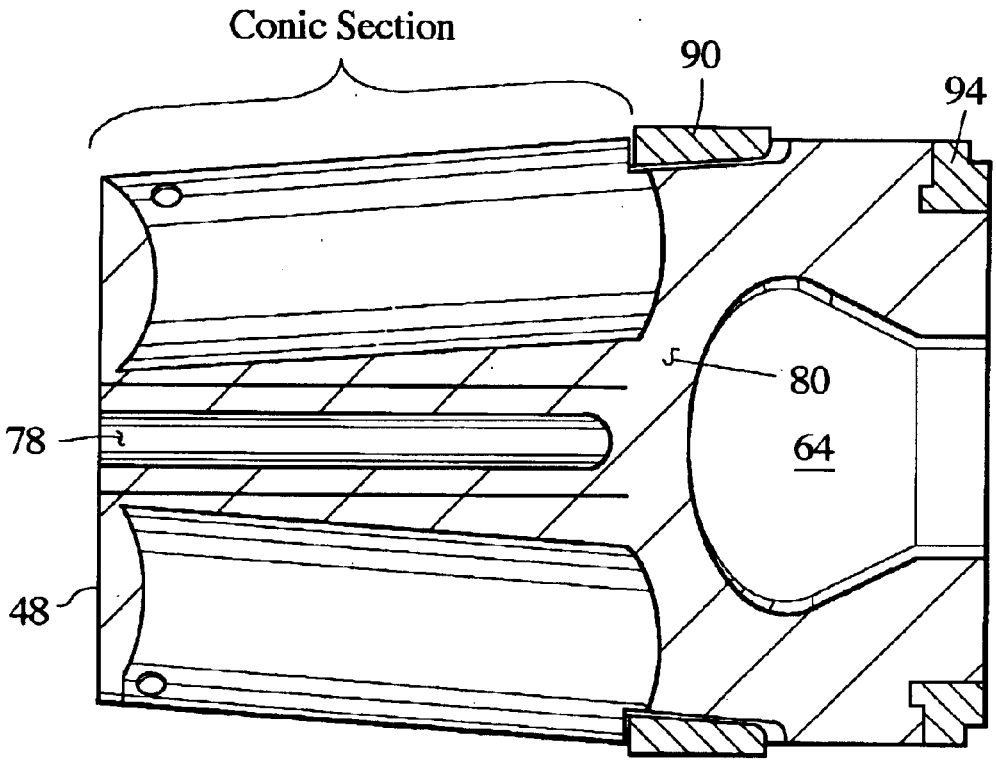
FIG. 8 is a simplified diagrammatic cross-section of the base structure, further illustrating the hemispherical dome bulkhead structure.

The load transfer event is illustrated in FIG. 7B, a partial cutaway of the base 40. During the exit of the base 40 from the gun tube, it is assumed that atmospheric pressure (Pa) exists on the outside of the base, whereas gun barrel pressure (Pb) reacts on the end and on the triangular cavities 70. The Pb pressure is very high and forces the base walls 70 to deflect into the insert 44, in turn compressing the insert and pressing on the fin. If the elastic modulus of the insert is too low, this would allow too much deflection of the base wall 76, causing yielding or failure. If the elastic modulus is too high, then the pressure Pb may not press against the fin with adequate force to retain the fin until the barrel pressure Pb bleeds off to atmospheric pressure.

Figure 9:
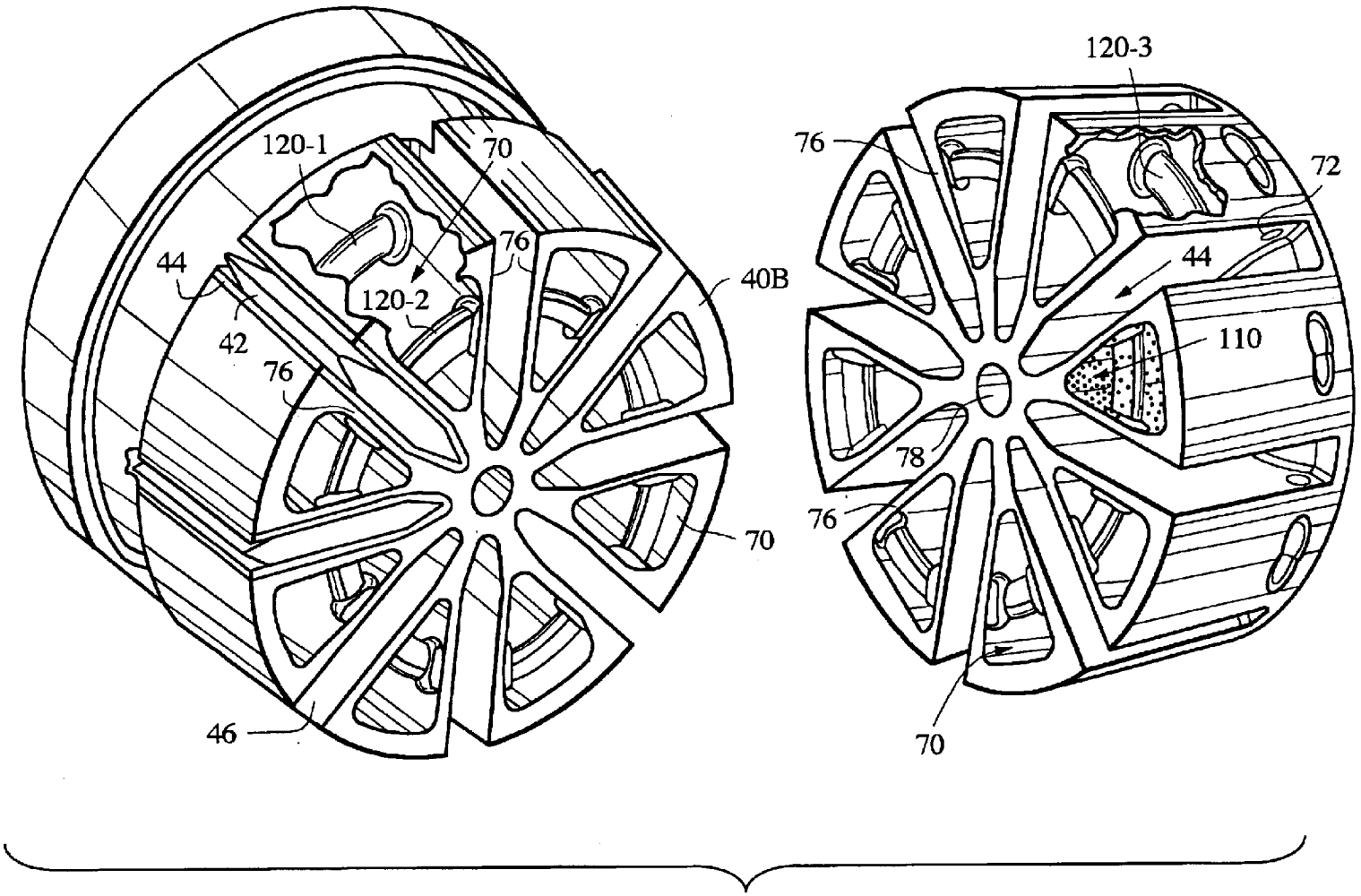
FIG. 9 is a cut-away diagrammatic view of a first alternate embodiment of the base structure, employing strengthening struts in cavities.
Figure 10:
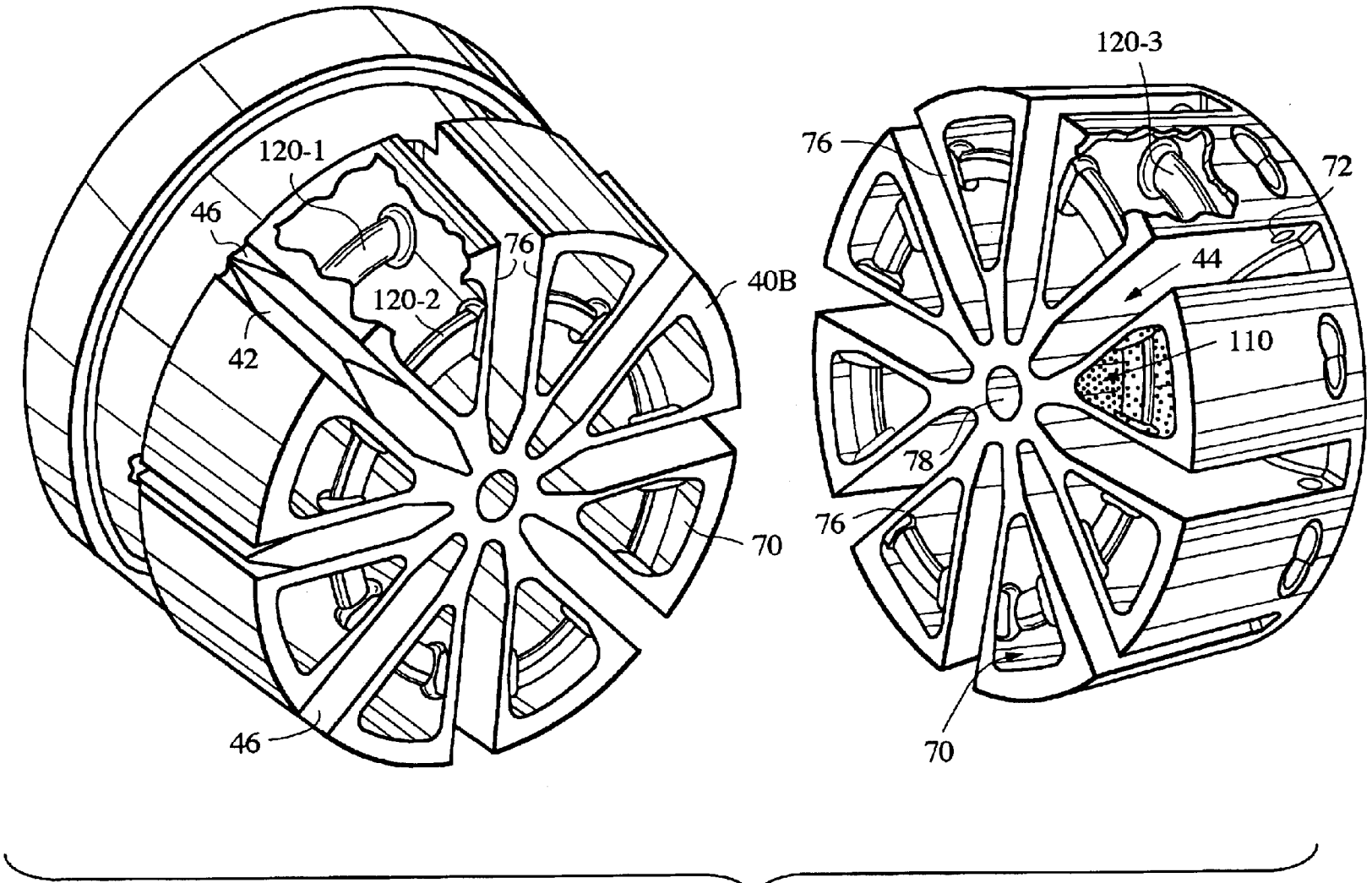
FIG. 10 is a cut-away diagrammatic view of a second alternate embodiment of the base structure, employing the strengthening struts and without fin insert structures.
Figure 11:
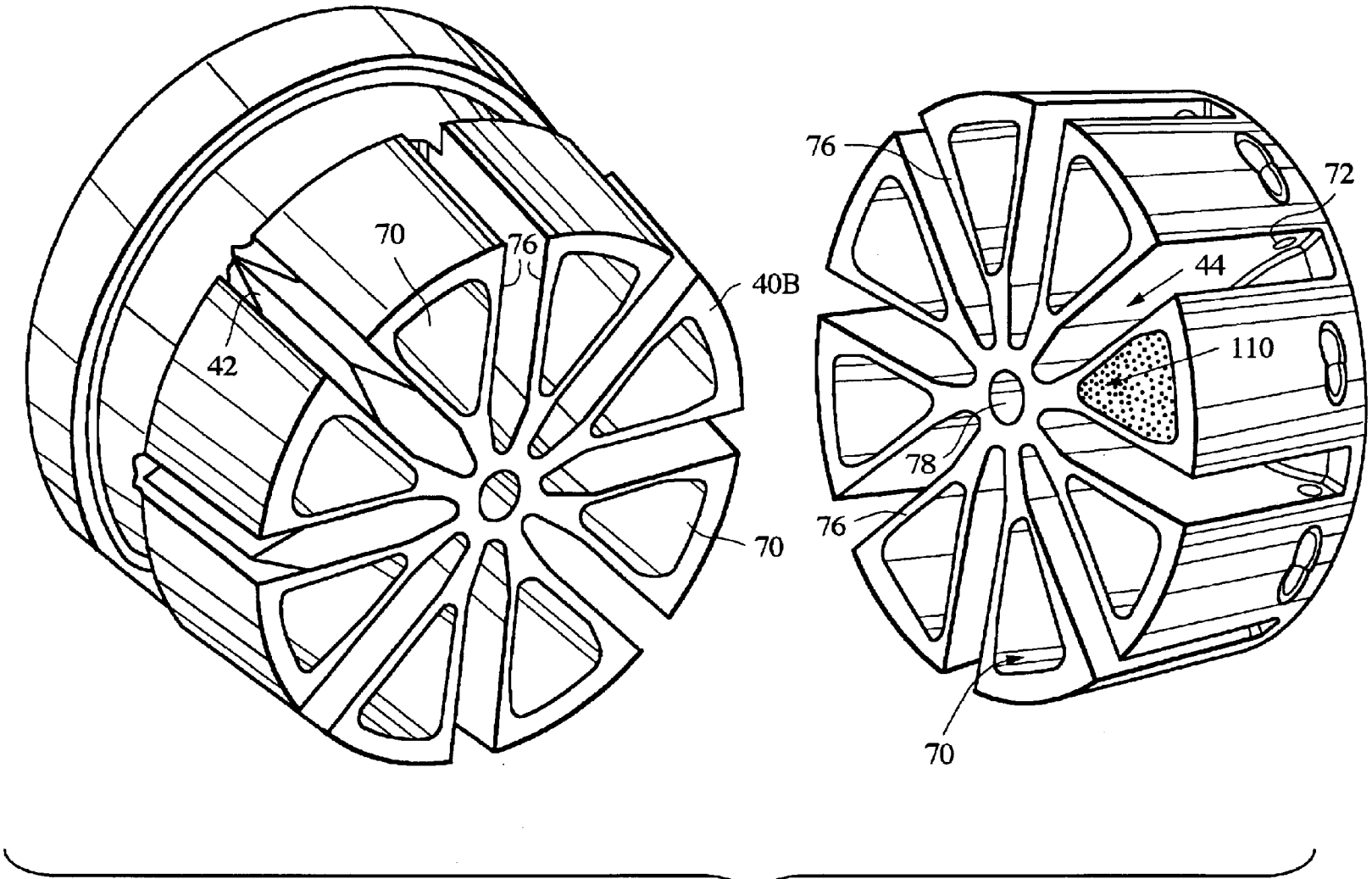
FIG. 11 is a cut-away diagrammatic view of third alternate embodiment of a base structure, without strengthening struts in the cavities and fin insert structures.

FIGS. 9–11 illustrate alternate embodiments of the base structure. FIG. 9 is similar to FIG. 7A, but with one cavity 70 broken away to show a plurality of struts 120-1, 120-2 and 120-3 formed in each pie-shaped cavity 70 between the cavity ribs or walls 76. These struts can be integrally formed with the base structure. Alternatively, and less desirably, the struts can be fastened in place, e.g. by welding. In this exemplary embodiment, there are three struts, although a fewer or greater number of struts can be formed in each cavity. The struts add rigidity to the base structure, and provide increased strength.

FIG. 10 illustrates a further alternate embodiment, wherein the struts 120-1, 120-2, 120-3 are employed in the cavities 70. In this embodiment, the fin insert structures (inserts 44 of the embodiment of FIGS. 1–8 and the embodiment of FIG. 9) are omitted from the base structure. In some applications, the inserts may not be needed, particularly with the strengthening struts added to the cavities.

FIG. 11 shows yet another alternate embodiment. In this embodiment, the cavities do not include the struts of the embodiments of FIGS. 9–10. Further, there are no fin insert structures such as insert structures 44 of the exemplary embodiment of FIGS. 1–8. For this embodiment, the base structure is fabricate so that the cavity ribs 76 have sufficient strength to oppose the forces experienced during projectile firing so that the fins are not damaged. For some applications, the base material can be selected from a high strength material, such as high strength titanium or high strength steel. For other applications, the width of the ribs can be designed to meet the strength requirement.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A base for a projectile, comprising:

a base structure having a forward bulkhead in a hemispherical dome shape, the base structure including an aft end having a plurality of cavities formed therein, the cavities separated by a set of corresponding radial rib structures extending outwardly to a base outer surface, with at least one strut member disposed in each cavity and extending between corresponding opposed rib structures;

a plurality of fin slots defined in the base structure; and a plurality of deployable fins mounted to the base structure and supported within the fin slots for movement between a stowed position and a deployed position.

2. The base of claim 1, wherein each of said at least one strut member has a generally circular cross-sectional configuration.

3. The base of claim 1, wherein said fin slots are defined in respective ones of said rib structures.

4. The base of claim 1, wherein the base structure is a unitary, one-piece structure.

5. The base of claim 1, wherein the base structure is fabricated of titanium or a titanium alloy.

6. The base of claim 1, wherein each of the fins are pivotally mounted in said slots for pivoting movement about a pivot point from said stowed position to said deployed position.

7. A base for a projectile, comprising:

a base structure having a forward bulkhead structure, the base structure including an aft end having a plurality of cavities formed therein, the cavities separated by a set of corresponding radial rib structures extending outwardly to a base outer surface, with at least one strut member disposed in each cavity and extending between corresponding opposed rib structures;

a plurality of fin slots defined in the base structure; and a plurality of deployable fins mounted to the base structure and supported within the fin slots for movement between a stowed position and a deployed position.

8. The base of claim 7, wherein each of said at least one strut member has a generally circular cross-sectional configuration.

9. The base of claim 7, wherein said fin slots are defined in respective ones of said rib structures.

10. The base of claim 7, wherein the base structure is a unitary, one-piece structure.

11. The base of claim 7, wherein the base structure is fabricated of titanium or a titanium alloy.

12. A base for a projectile, comprising:

a base structure having a forward bulkhead structure, the base structure including an aft end having a plurality of cavities formed therein, the cavities separated by a set of corresponding radial rib structures extending outwardly to a base outer surface, with at least one strut member disposed in each cavity and extending between corresponding opposed rib structures;

a plurality of fin slots defined in the base structure;

a plurality of insert structures fitting into corresponding ones of the fin slots;

a plurality of deployable fins mounted to the base structure and supported within the insert structures for movement between a stowed position and a deployed position.

13. The base of claim 12, wherein each of said at least one strut member has a generally circular cross-sectional configuration.

14. The base of claim 12 herein said fin slots are defined in respective ones of said rib structures.

15. The base of claim 12 wherein the base structure is a unitary, one-piece structure.

16. The base of claim 12 wherein the base structure is fabricated of titanium or a titanium alloy.

17. The base of claim 12, wherein forward bulkhead forms a hemispherical dome shape.

18. A base for a projectile, comprising:

a base structure having a forward bulkhead structure, the base structure including an aft end having a plurality of cavities formed therein, the cavities separated by a set of corresponding radial rib structures extending outwardly to a base outer surface;

a plurality of fin slots defined in respective ones of said rib structures in the base structure; and a plurality of deployable fins mounted to the base structure and supported within the fin slots for movement between a stowed position and a deployed position; and wherein during firing of the projectile from a gun barrel, gasses at high pressure generated from a propellant enter said cavities, and said radial rib structures and said bulkhead structure have sufficient strength to prevent deflection of said radial rib structures into contact with said fins.

19. The base of claim 18 herein said fin slots are defined in respective ones of said rib structures.

20. The base of claim 18 wherein the base structure is a unitary, one-piece structure.

21. The base of claim 18 wherein the base structure is fabricated of high strength titanium or high strength steel.

22. The base of claim 18, wherein forward bulkhead structure forms a hemispherical dome shape.

* * * * *